US005533612A

United States Patent [19]

Focke

[11] Patent Number: 5,533,612

[45] Date of Patent: Jul. 9, 1996

[54] HINGE-LID PACK FOR CIGARETTES

[75] Inventor: Heinz Focke, Verden, Germany

[73] Assignee: FOCKE & CO. (GmbH & Co.), Verden, Germany

[21] Appl. No.: 354,762

[22] Filed: Dec. 12, 1994

[30] Foreign Application Priority Data

Dec. 16, 1993 [DE] Germany ..... 43 42 836.3

[51] Int. Cl.[6] ..... B65D 85/10

[52] U.S. Cl. ..... 206/268; 206/265; 206/273

[58] Field of Search ..... 206/265, 268, 206/271, 273

[56] References Cited

U.S. PATENT DOCUMENTS

| | | | |
|---|---|---|---|
| 348,924 | 9/1886 | Muson | 206/268 |
| 2,361,597 | 10/1944 | Buttery . | |
| 2,872,097 | 2/1959 | Graybill | 206/268 |
| 4,732,276 | 3/1988 | Knecht | 206/273 |
| 4,948,038 | 8/1990 | Moeller . | |
| 5,178,268 | 1/1993 | Talley et al. | 206/273 |
| 5,181,607 | 1/1993 | Focke et al. | 206/273 |
| 5,236,084 | 8/1993 | Evers . | |
| 5,363,955 | 11/1994 | Fleenor | 206/268 |
| 5,375,704 | 12/1994 | Focke et al. | 206/265 |

FOREIGN PATENT DOCUMENTS

| | | |
|---|---|---|
| 1800171 | 11/1958 | Germany . |
| 1054373 | 4/1959 | Germany . |
| 1078934 | 3/1960 | Germany . |
| 7826336 | 12/1978 | Germany . |
| 8017001 | 10/1980 | Germany . |
| 620200 | 7/1978 | U.S.S.R. . |
| 819206 | 9/1959 | United Kingdom . |

*Primary Examiner*—David T. Fidei

*Attorney, Agent, or Firm*—Sughrue, Mion, Zinn, Macpeak & Seas

[57] ABSTRACT

Hinge-lid packs (10) for cigarettes are comprised of a box part (14) and a lid (15) hingedly connected thereto. In order to secure the closing position of such a hinge-lid pack (10), an insertion flap (40) is attached to the lid front wall (25) as a continuation thereof. This insertion flap (40) is inserted into a gap (41) in the closed hinge-lid pack (10), which is formed between a collar front wall (36) of a collar (35) and a front wall (16) of the box part (14).

8 Claims, 2 Drawing Sheets

HINGE-LID PACK FOR CIGARETTES

BACKGROUND OF THE INVENTION

The invention relates to a hinge-lid pack for cigarettes, having a box part with a front wall, rear wall and side walls, and a lid with a lid front wall, lid side walls and a lid rear wall hingedly connected to the rear wall of the box part, and a folding tab attached to the free edge of the lid front wall, and a collar with a collar front wall and collar side tabs being arranged in the box part in such a manner that the collar is partly surrounded by the lid in the closing position.

Hinge-lid packs are an internationally widespread pack type for cigarettes. In a conventional construction, a cigarette group is surrounded by an inner wrapping and forms a cigarette block as the pack contents. The pack itself is made of thin cardboard. The collar is made from a separate blank which is also made of thin cardboard. A cellulose film or thin plastic film is provided as an outer wrapping.

A certain disadvantage of hinge-lid packs is that the lid does not remain in an accurate position when the pack is closed. This is particularly disadvantageous in the case of hinge-lid packs without an outer wrapping. When handling such packs before using them the first time, for example during the withdrawal from a cigarette vending machine, there is a danger of involuntarily opening the pack.

SUMMARY OF THE INVENTION

The invention is based on the object to further develop and to improve hinge-lid packs for cigarettes or similar articles such that an improved closing position of the lid is ensured, without essentially changing the design of the pack.

To attain this object the pack according to the invention is characterized in that an insertion flap is attached to the lid front wall as a continuation thereof, said lid being entirely inserted between the collar front wall and the front wall of the box part, in such a manner that the closing edge of the box part or the front wall thereof, and a lower lid edge of the lid front wall abut one another.

In the pack according to the invention a standard blank is employed which is only slightly modified. A folding tab attached to the lid front wall, which is also present in conventional hinge-lid packs, in particular a lid inner tab is, according to the invention, not folded against the inner side of the lid front wall and attached thereto. On the contrary, the folding tab remains in the plane of the lid front wall and serves as an insertion flap. In the closing position the insertion flap enters into a gap formed between the front wall of the box part and the collar front wall and is completely covered thereby. The insertion flap is positively and frictionally fixed which results in an improved closing position. Since the lid front wall and the insertion flap form a continuous plane, the undesired closing gap between a lid edge of the lid front wall and a closing edge of the front wall of the box part, which is normal in hinge-lid packs, is also avoided.

The folding tab attached to the lid front wall, which serves as an insertion flap, takes the form of a tongue which simplifies entering the flap into the inserted position.

Further details of the invention relate to the novel fixation of the collar in the box part by means of glue spots arranged in selected positions. Furthermore, shaping or embossing of the collar front wall and/or the insertion flap can simplify the handling of the pack.

An exemplary embodiment of the pack according to the invention is explained in detail in the following with reference to the drawings in which

DESCRIPTION OF A PREFERRED EMBODIMENT

Figure 1:
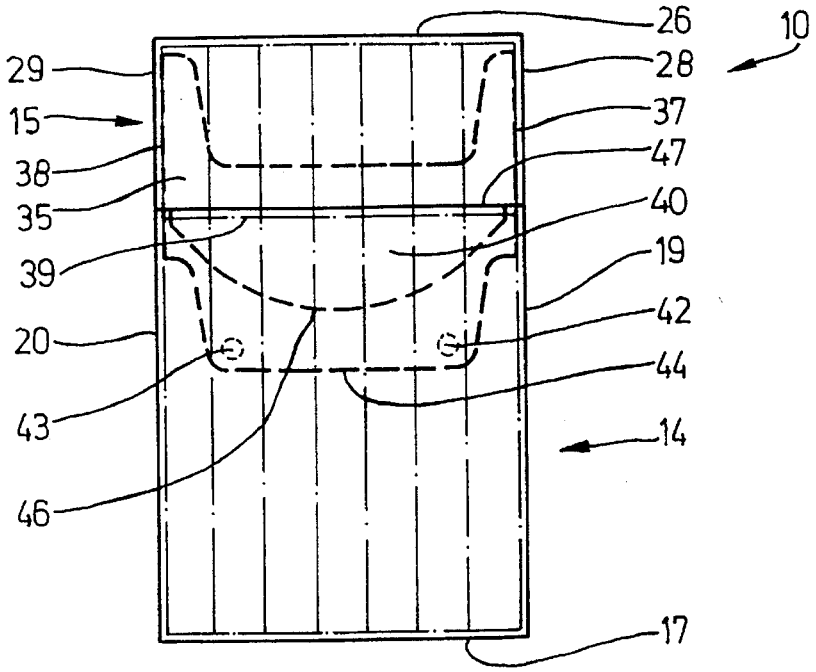
FIG. 1 shows a front view of a hinge-lid pack with an insertion flap in the closing position.
Figure 3:
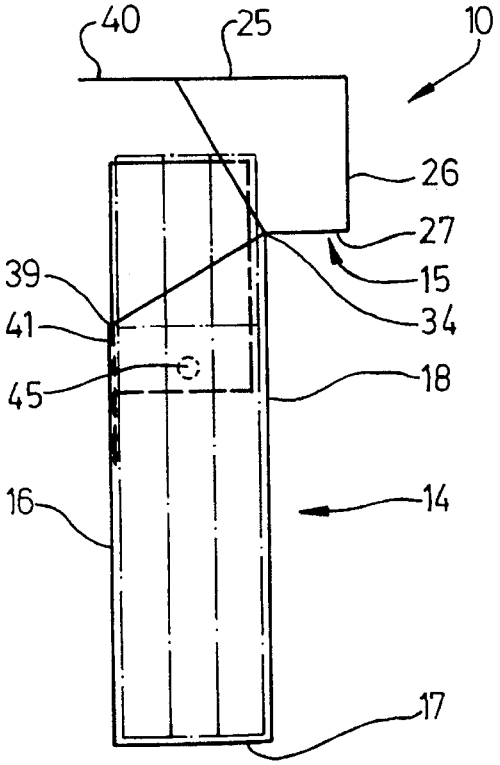
FIG. 3 shows the hinge-lid pack with insertion flap in the opened position in a view similar to FIG. 2.
Figure 2:
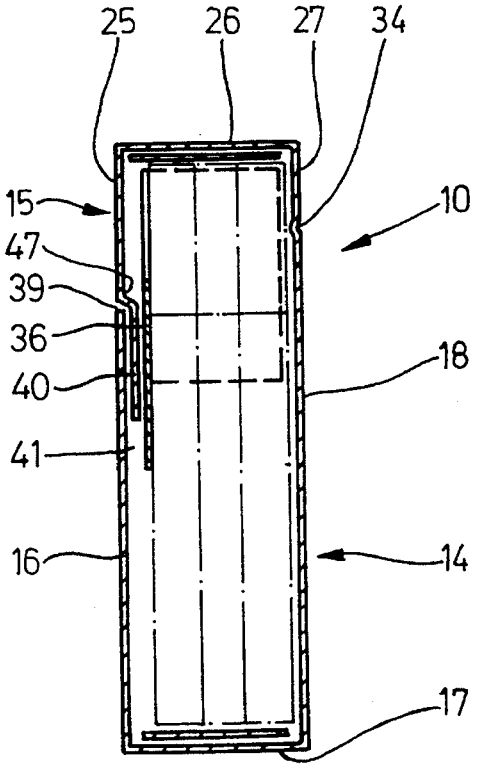
FIG. 2 shows a side view of the hinge-lid pack according to FIG. 1.
Figure 4:
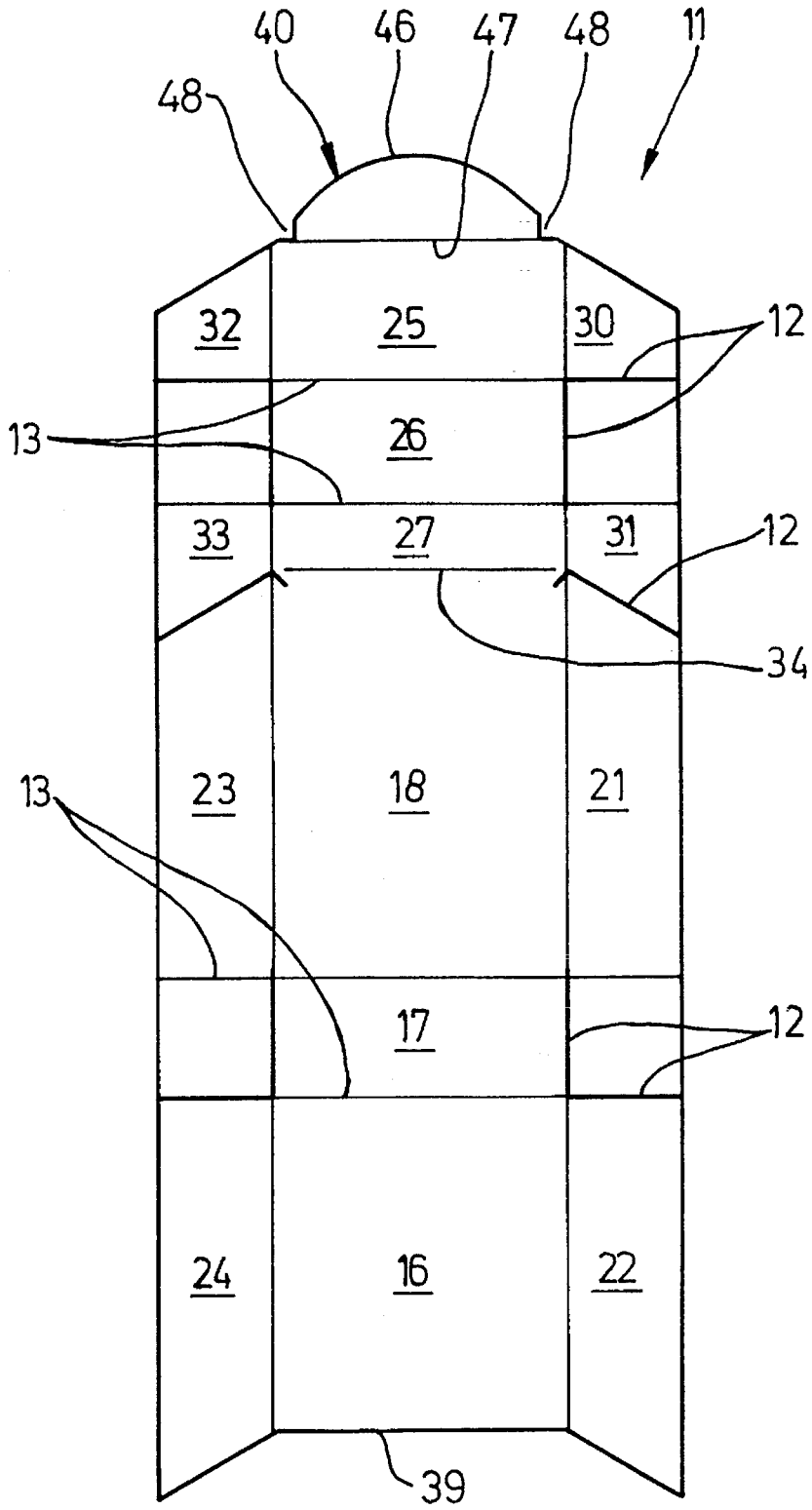
FIG. 4 shows a blank for the hinge-lid pack in a spread-out position.

A hinge-lid pack 10 is usually made from a blank 11 (FIG. 4) of thin cardboard. This blank is shaped by punch cuts 12 and folding lines 13 such that the hinge-lid pack 10 forms a box part 14 and a lid 15. The box part 14 is comprised of a front wall 16, bottom wall 17, rear wall 18, and two narrow, upright side walls 19, 20. The latter are formed from two respective side tabs 21, 22, and 23, 24, which overlap one another and which are attached to one another by means of adhesive bonding.

The lid 15 is comprised of a lid front wall 25, lid top wall 26, lid rear wall 27 and lid side walls 28, 29, which are also made from two respective overlapping lid side tabs 30, 31 and 32, 33, which are attached to one another by means of adhesive bonding. The lid rear wall 27 is connected to the rear wall 18 of the box part 14 via an articulated line 34.

A collar 35 is arranged in the box part 14. This collar is made from a separate blank which is also made of thin cardboard. The collar 35 forms a collar front wall 36 in the region of the front wall 16 of the box part 14, and transversely directed collar side tabs 37, 38. The latter abut the inner side of the side walls 19, 20 of the box part 14. A portion of the collar 35, which projects from the box part 14, is surrounded by the lid in the closing position of the pack.

The lid front wall 25 is provided with a folding tab. This folding tab is not folded against the inner side of the lid front wall 25 and connected thereto in the ready hinge-lid pack 10, but extends in continuation or prolongation of the lid front wall 25. The folding tab serves as insertion flap 40 for the hinge-lid pack 10 in the closing position of the lid 15.

To this end, the insertion flap 40 is inserted into a gap 41 which is formed between the front wall 16 of the box part 14 and the collar front wall 36, during the closing movement. Thereby, a stable closing position is ensured which can easily be removed by grasping the lid 15 when opening the hinge-lid pack 10. The insertion flap 40 is completely inserted into the gap 41 when the hinge-lid pack 10 is closed and is thus overlapped by the front wall 16 of the box part 14. An upper closing edge 39 of the front wall 16 can thereby abut an opposing edge of the lid 15, specifically a lower, parallel lid edge 47, just as in conventional hinge-lid packs.

The collar 35 is normally fixed in the box part 14 by means of adhesive bonding. In the present case the glue spot is located outside of the region of the collar front wall 36 which is covered by the insertion flap 40 in the closing position. In the shown embodiment two glue spots 42, 43 are arranged next to a lower edge 44 of the collar front wall 36. The glue spots 42, 43 ensure sufficient support for the collar 35, on the one hand, but allow the insertion of the insertion flap 40 into the closing or clamping position, on the other.

In the present embodiment the collar 35 is additionally fixed to the side walls 19, 20 of the box part 14 in the region of collar side tabs 37, 38 by means of glue spots 45.

To simplify the handling when opening and closing the pack, and for improving the outer appearance, material deformations, specifically material embossings, may be formed in the region of the collar front wall 36 and/or in the region of the insertion flap 40. The latter may be set back relative to the front side of the collar front wall 36 by means of a deforming embossing. This results in a continuous transition from the lid front wall 25 to the front wall 16 of the pack part 14 when the pack is closed.

Additionally or alternatively, at least a part region of the collar front wall 36 may be set back relative to the front wall 16 of the box part 14 by embossing so that an open gap for inserting the insertion flap 40 is formed.

The insertion flap 40 is designed in a special manner in the present case, specifically tongue-shaped. An outer, free edge 46 is designed with the shape of an arc. This ensures an additional simplification when inserting the insertion flap 40 into the closing position. In the present exemplary embodiment the insertion flap 40 is designed with slightly less width than the lid front wall 25 by means of cutouts 48. Thereby the lid edge 47, at its ends, is exposed over a length of 3 mm to 5 mm. The dimensions of the insertion flap 40 thus also simplify the closing operation.

What is claimed is:

1. A hinge-lid pack for cigarettes, comprising:

a) a box part (14) comprising a pack front wall (16), a pack rear wall (18), a pack bottom wall (17), and two narrow pack side walls (19, 20);

b) a lid (15) comprising a lid front wall (25), a lid rear wall (27), a lid top wall, and two lid side walls (28, 29), c) wherein, for opening and closing the lid (15), the lid rear wall (27) is pivotably connected to the pack rear wall (18);

d) a collar (35) comprising a collar front wall (36) and two collar side tabs (37, 38), and being located in the box part (14), e) wherein the collar (35) has an upper portion which projects from an upper, transversely directed closing edge (39) of the pack front wall (16) and which is surrounded by the lid (15) in a closed position of the lid (15); and f) an insertion flap (40) formed as a downward continuation of the lid front wall (25) so that the insertion flap (40) adjoins the lid front wall (25) in one piece, g) wherein the insertion flap (40) rests entirely between the collar front wall (36) and the pack front wall (16) in the closed position of the lid (15) such that the insertion flap (40) is covered by the pack front wall (16) on an outside, and by the collar front wall (36) on the inside, h) wherein the insertion flap (40) has a smaller width than the adjoining lid front wall (25) and the collar front wall (36), and i) wherein the insertion flap (40) is set back into the box part (14) by pressure deformation relative to the lid front wall (25) thereby forming a lower, transversely directed lid edge (47) such that, in the closed position, there is a continuous transition between the lid front wall (25) and the pack front wall (16), and the lid edge (47) adjoins said closing edge (39).

2. The hinge-lid pack as claimed in claim 1, wherein the insertion flap (40) has a contour which tapers in the direction of a free end thereof, and which has a tongue-shaped design with a free edge (46) in the shape of a graduated circle.

3. The hinge-lid pack as claimed in claim 1 or 2, wherein the collar front wall (36) is attached to the pack front wall (16) of the box part (14), in a region outside of the insertion flap of the insertion flap (40) in the closed position, by adhesive bonding.

4. The hinge-lid pack as claimed in claim 1 or 2, wherein the collar side tabs (37, 38) are attached to an inner side of the pack side walls (19, 20) of the box part (14) by glue spots (45).

5. The hinge-lid pack as claimed in claim 1 or 2, wherein the collar front wall (36) is slightly set back relative to the pack front wall (16) of the box part (14) to form a gap (41) for insertion of the insertion flap (40).

6. The hinge-lid pack as claimed in claim 3, wherein the adhesive bonding comprises two glue spots (42, 43) adjacent to a lower edge (44) of the collar front wall (36).

7. The hinge-lid pack as claimed in claim 5, wherein the collar front wall (36) is set back by embossing.

8. The hinge-lid pack as claimed in claim 7, wherein the embossing comprises pressure deformation.

* * * * *